US006789460B2

(12) United States Patent
Köhnert

(10) Patent No.: US 6,789,460 B2
(45) Date of Patent: Sep. 14, 2004

(54) MULTIPART COOLED PISTON FOR A COMBUSTION ENGINE

(75) Inventor: Hans-Jürgen Köhnert, Winnenden (DE)

(73) Assignee: Mahle GmbH, Stuttgart (DE)

( * ) Notice: Subject to any disclaimer, the term of this patent is extended or adjusted under 35 U.S.C. 154(b) by 0 days.

(21) Appl. No.: 10/270,254

(22) Filed: Oct. 11, 2002

(65) Prior Publication Data

US 2004/0055460 A1 Mar. 25, 2004

(30) Foreign Application Priority Data

Sep. 25, 2002 (DE) ..... 102 44 511

(51) Int. Cl.[7] ..... F01B 31/08
(52) U.S. Cl. ..... 92/186; 92/231
(58) Field of Search ..... 92/186, 231, 208, 92/172

(56) References Cited

U.S. PATENT DOCUMENTS 4,363,293 A * 12/1982 Munoz et al. ..... 92/186
4,368,697 A * 1/1983 Moebus ..... 92/186
5,086,736 A * 2/1992 Wiemann ..... 92/186
5,136,992 A * 8/1992 Bregler et al. ..... 92/222
5,179,916 A * 1/1993 Schonfeld ..... 92/217
6,622,613 B1 * 9/2003 Kortas et al. ..... 92/223

FOREIGN PATENT DOCUMENTS

DE WO 0053913 A1 * 9/2000 ..... F02F/3/00
JP 611 75 255 8/1986
WO WO 00 77379 12/2000

* cited by examiner

*Primary Examiner*—Edward K. Look
*Assistant Examiner*—Michael Leslie
(74) *Attorney, Agent, or Firm*—Collard & Roe P.C.

(57) ABSTRACT

A multipart cooled piston for a combustion engine has a piston upper part of steel comprising a combustion bowl and a ring wall with ring belt, and a piston lower part comprising a piston skirt, pin bosses for receiving the piston pin connecting the piston to the connecting rod, and pin boss supports connected to the piston skirt. An inexpensive manufacture and high form stability are achieved in that a cooling channel formed in the piston upper part has holes towards the piston crown spread over its circumference, with the piston material present between such holes forming supporting ribs that each form sections of an all-round ring rib radially to the longitudinal piston axis (K), The piston lower part has an annular and all-round carrier rib with a connection surface connected to the pin boss supports. The piston upper part and the piston lower part are non-detachably connected by means of the connection surfaces of the ring rib and the carrier rib, and the cooling channel is closable by a cooling channel cover.

8 Claims, 1 Drawing Sheet

MULTIPART COOLED PISTON FOR A COMBUSTION ENGINE

BACKGROUND OF THE INVENTION

1. Field of the Invention

The invention relates to a multipart cooled piston for a combustion engine with a piston upper part of forged steel comprising a combustion bowl in the piston crown and a ring wall with ring belt, and with a piston lower part comprising a piston skirt, pin bosses for receiving the piston pin connecting the piston to the connecting rod, and pin boss supports connected to the piston skirt, and to a method for manufacture of this piston.

2. The Prior Art

A multipart cooled piston for a combustion engine is known from Japanese Patent JP 61175255 A. This piston has a number of ribs at the level of the ring belt, between which is arranged a thermally insulating plate for minimization of the heat transfer from the combustion chamber bowl to the ring belt.

From WO 00/77379 A1, a further piston for a combustion engine is known which has a wall section with several transverse walls made of thin metal sheet and radially arranged in order to improve the heat dissipation in the cooling channel.

The above designs are not suitable for improvement of the piston with respect to its stability for high ignition pressures and temperatures as encountered in modern diesel engines.

SUMMARY OF THE INVENTION

It is therefore an object of the present invention to provide a piston concept for a multipart cooled piston with which inexpensive manufacture is assured and with which piston deformation due to the effects of high gas pressures and temperatures can be effectively countered.

The problem is solved in particular in that a cooling channel formed in the piston upper part has holes spread over its circumference towards the piston crown, with the piston material present between such holes forming supporting ribs that each form sections of an all-round ring rib radially to the longitudinal piston axis. A piston lower part has an annular and all-round carrier rib with a connection surface connected to the pin boss supports. The piston upper part and the piston lower part are non-detachably connected to one another by the connection surfaces of the ring rib and the carrier rib by means of a welding or soldering process, with the cooling channel being closable by a cooling channel cover.

With a piston manufactured in this way, the cooling channel can be formed closer towards the piston crown or combustion bowl and nevertheless has excellent form stability. In addition, the arrangement of the supporting ribs effects a kind of chamber formation inside the cooling channel, i.e. creates shaker areas, whereby a prolongation of the dwell time of the cooling oil is achieved and hence an improved heat dissipation of the piston areas to be cooled.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 5:
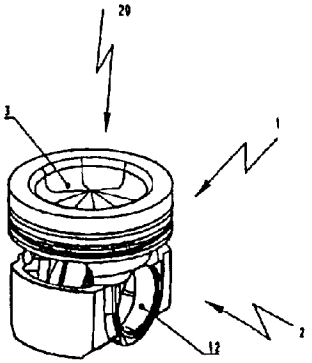
FIG. 5 shows a piston in accordance with the invention, in a perspective view.

Referring now in detail to the drawings, the multipart cooled piston 20 in accordance with the invention comprises a forged piston upper part 1 with a combustion bowl 3, ring wall 4 with ring belt 11, and a cooling channel 7, and a piston lower part comprising a piston skirt 9 and pin boss supports 6, as shown in FIG. 5. In accordance with the embodiment, holes 14 are provided in the cooling channel 7 that are arranged symmetrically spread over the circumference and are positioned in the direction of the piston crown, i.e. parallel to the longitudinal piston axis K. The depth $h_B$ of the holes 14 is not more than half the total height H of the cooling channel 7, so that an unhindered circulation of cooling oil remains assured. Thanks to this design, shaker areas are created for the cooling oil which increase the cooling effect. In the Figures, the respective oil inlet and outlet are not shown. By means of the cooling channel cover 13, which comprises a two-part spring element provided with an oil inlet and an oil outlet (not shown), the cooling channel 7 is closed at its end open to the piston crown 9.

Figure 3:
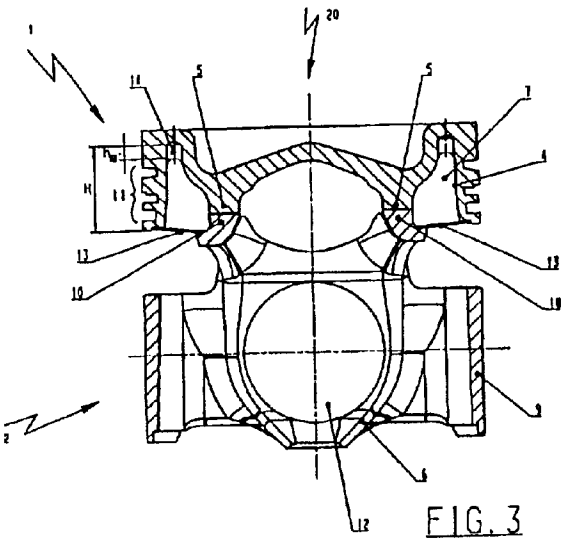
FIG. 3 shows a piston in accordance with the invention in a cross-section transverse to the piston pin direction, in a first and a second embodiment.
Figure 4:
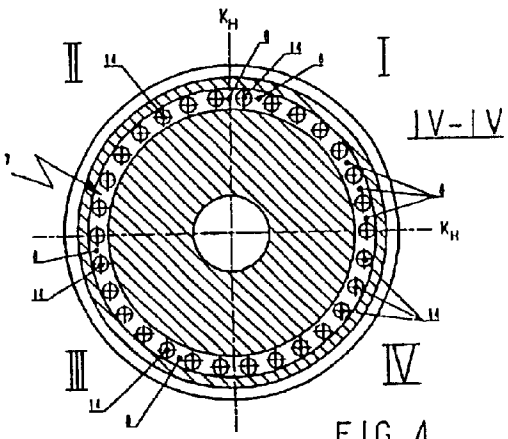
FIG. 4 shows a piston in accordance with the invention, in a section along the line IV—IV in FIG. 1.

As shown in FIGS. 3 and 4, the material areas referred to as supporting ribs 8 between the holes 14 merge radially to the longitudinal piston axis K into sections of a ring rib 5, which taken together form the ring rib 5. The holes 14 and hence the supporting ribs 8 are, as shown in FIG. 4, arranged radially symmetrically over the circumference of the cooling channel 7. In a further embodiment (not shown), the number of holes and hence the spread of the supporting ribs 8 can be such that in the major/minor thrust direction D or GD a larger number of supporting ribs 8 is arranged than transversely thereto, i.e., a non-symmetrical spread in the cooling channel 7 is achieved on the circumferential side. In this way, the spread of the holes 14 and hence of the supporting ribs 8 in the cooling channel 7 can, if the latter is characterized by the quadrants I–IV formed by the main piston axes $K_H$, be such that within a quadrant a symmetrical (FIG. 4) or non-symmetrical (not shown) or partially symmetrical (FIG. 6) spread is achieved, or the spread is dependent on the local temperature distribution in the piston crown.

Figure 6:
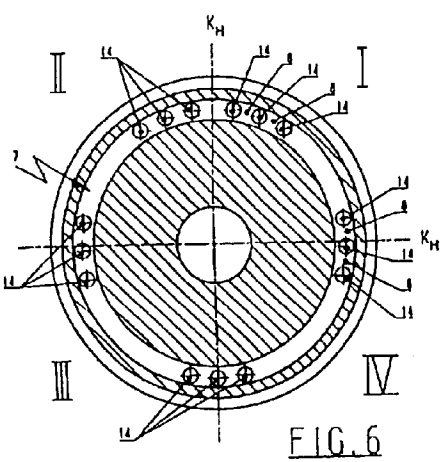
FIG. 6 shows a piston in accordance with the invention, in a section along the line IV—IV in FIG. 1, in a further embodiment.

As a result, in the event of loading the temperature and tension strains of the piston can be better countered. The holes 14 can be designed as round holes, as shown in FIGS. 4 and 6, or as elongated holes (not shown) whose long sides face radially outwards from the piston center to the piston wall. With these respective embodiments of the hole arrangements, it is achieved that the holes have different spacings and hence the material designed as supporting ribs 8 is increased. For further influence on the heat dissipation from the combustion bowl 3, the ends of the holes 14 can be round or, as shown in FIG. 1, angular.

Figure 1:
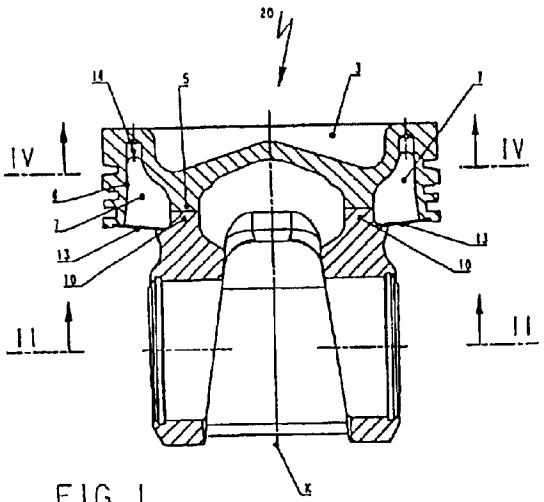
FIG. 1 shows a piston in accordance with the invention in a cross-section in the pin direction.
Figure 2:
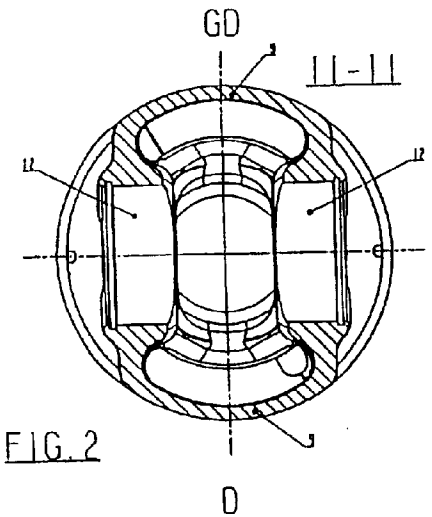
FIG. 2 shows a piston in accordance with the invention from below, in a section along the line II in accordance with FIG. 1.

The axes of the holes 14 can, as shown in FIG. 1, be arranged parallel to the longitudinal piston axis K and/or, i.e. in combination, at an acute angle thereto, with the holes 14 preferably pointing in the direction of the combustion bowl 3.

An annular and all-round carrier rib 10 is formed from the pin boss supports 6, as shown in FIG. 3, and corresponds in its geometrical dimensions to the ring rib 5. The piston upper part 1 and the piston lower part 2 are non-detachably connected to one another by the carrier rib 10 and ring rib 5 by means of a welding or soldering process. The piston upper part 1 is advantageously made from an oxidation-resistant and/or heat-resistant material and the piston lower part 2 from a precipitation-hardening ferritic-perlitic steel or tempered steel.

Accordingly, while only a few embodiments of the present invention have been shown and described, it is obvious that many changes and modifications may be made thereunto without departing from the spirit and scope of the invention.

What is claimed is:

1. A multipart cooled piston for a combustion engine, comprising:

a piston upper part of forged steel comprising a piston crown, a combustion bowl in the piston crown and a ring wall with a ring belt;

a piston lower part comprising a box shaped piston skirt, pin bosses for receiving a piston pin connecting the piston to a connecting rod, and pin boss supports connected to the piston skirt, wherein between the piston upper and lower part, an annular recess is arranged;

a cooling channel formed in the piston upper part has holes spread over its circumference towards the piston crown, with piston material present between such holes forming supporting ribs that each form sections of an all-round ring rib with a surface radially to a longitudinal piston axis (K), the piston lower part has an annular and all-round carrier rib with a connection surface connected to the pin boss supports, the piston upper part and the piston lower part are non detachably connected by means of connection surfaces of the ring rib and the carrier rib, and the cooling channel is closable by a cooling channel cover.

2. A piston according to claim 1, wherein the holes are arranged symmetrically spread over the circumference of the cooling channel.

3. A piston according to claim 1, wherein the holes are arranged asymmetrically spread over the circumference of the cooling channel.

4. A piston according to claim 1, wherein the holes are of a depth ($h_B$) which is no more than half a total height (H) of the cooling channel.

5. A piston according to claim 1, wherein the holes have axes and wherein at least part of the axes of the holes run parallel to the longitudinal piston axis (K).

6. A piston according to claim 1, wherein the holes have a cylindrical or elongated form.

7. A piston according to claim 1, wherein the non-detachable connection of the piston upper and lower parts is a welded or soldered connection.

8. A piston according to claim 1, wherein the piston upper part comprises an oxidation-resistant or heat resistant material and the piston lower part a precipitation-hardening ferritic-perlitic steel or tempered steel.

* * * * *